United States Patent [19]

Oinonen et al.

[11] Patent Number: 4,601,441

[45] Date of Patent: Jul. 22, 1986

[54] ARRANGEMENT FOR WEB WINDING

[75] Inventors: Hannu Oinonen; Jyrki Jääskeläinen, both of Järvenpää , Finland

[73] Assignee: Oy Wärtsilä Ab, Helsinki, Finland

[21] Appl. No.: 608,358

[22] Filed: May 9, 1984

[30] Foreign Application Priority Data

May 12, 1983 [FI] Finland ..... 831671

[51] Int. Cl.[4] ..... B65H 19/20

[52] U.S. Cl. ..... 242/56 R; 242/66

[58] Field of Search ..... 242/56 R, 66

[56] References Cited

U.S. PATENT DOCUMENTS

| | | | |
|---|---|---|---|
| 2,915,255 | 12/1959 | Phelps | 242/56 R |
| 3,841,578 | 10/1974 | Dorfel | 242/66 |
| 4,133,495 | 1/1979 | Dowd | 242/66 |
| 4,157,794 | 6/1979 | Brandauer et al. | 242/66 |
| 4,345,722 | 8/1982 | Kuhn | 242/66 X |
| 4,370,193 | 1/1983 | Knauthe | 242/66 X |
| 4,456,190 | 6/1984 | Karttunen et al. | 242/66 X |
| 4,485,979 | 12/1984 | Dropcynski | 242/56 R |
| 4,516,735 | 5/1985 | Snygg | 242/56 R |

FOREIGN PATENT DOCUMENTS 2085413 4/1982 United Kingdom .

*Primary Examiner*—Stephen Marcus
*Assistant Examiner*—L. J. Peters
*Attorney, Agent, or Firm*—Dellett, Smith-Hill and Bedell

[57] ABSTRACT

An arrangement for winding a web on a roll core or the like in a support drum winder, which comprises a first and a second support drum, a web cutter, transfer means for the transfer of a complete wound roll from said support drums, supply means for the supply of a new roll core and guide and retainer devices for governing a web trail end and a front end formed by an engagement of the cutter with the web. The governing is carried out until a supplied core retains said web front end against the first support drum. The arrangement comprises means for a free new core supply from a location above the support drums in a position therebetween. The supply is carried out preferably by the free fall action and during the transfer of the complete roll. The retainer devices comprise retainer members separate from the first drum. These retainer members generate a force action against said first support drum.

40 Claims, 4 Drawing Figures

ARRANGEMENT FOR WEB WINDING

BACKGROUND OF THE INVENTION

The invention relates to an arrangement for web winding on a roll core or the like in a support drum winder, which comprises a first and a second support drum, a web cutter, transfer means for the transfer of a complete roll from the support drums, supply means for a new roll core and guide and retainer devices for governing said web until a supplied core retains said web against said first drum.

In the following specification and claims, the concept "first support drum" refers to that support drum, together with which the roll forms the first roll nip in the running direction of the web.

DESCRIPTION OF THE PRIOR ART

An arrangement is known from the British Patent Application No. 2 065 081, in which the new roll core is moved above the drums and in a channel between the support drums. The roll core is provided with a glue stripe along a mantle line. As a result hereof, the core must be supplied precisely oriented in the channel. This is cumbersome to carry out and requires high precision devices. The control of the web front end is questionable after the web cutting, also. The web front end can easily slip down between the support drums, which causes expensive halts in the winding process. The known arrangement requires further several operative devices, the functions of which must be synchronized mutually.

SUMMARY AND THE OBJECTS OF THE INVENTION

The object of the invention is to remove the problems described earlier by providing an arrangement, which guaranties in an uncomplicated way a secure and a profitable function of the equipment. An improvement object is to form a supply measure in which it is not necessary to move the supply means all the way into the winding position for a roll core supply therein. An uncomplicated web retainment in the winding position prior a new winding process is a further object.

The characteristics of the invention include that during the transfer of the complete roll, the new roll core is freely supplied from a location above the support drums in a position therebetween. The supplied core retains the generated web end, which is formed by the engagement of the cutter and the web, against the first support drum, and so the usual retainer devices can be deactivated. As this supply mode is not sensitive to any orientation generated by a rotation around the roll core axis, the free fall supply can be exploited to drop or to throw the new core between the drums. Retainer devices include members which are separate from the first drum and generate a force action against this drum.

By rotatably supporting the core supply means and the web cutter to a movable support arm of the transfer means, to which arm the pusher roll or drum is supported, the thrust against the complete roll and the web cutting are possible by means of the same operative device. This fact has a great importance in view of the production costs of the arrangement. Roll core supply means can be combined with the web cutter. Hereby it is possible to carry out by a common actuator device the delivery of the new roll core in to a supply location, from which it is freely supplied to the position between the drums. This device can, for instance, be a work cylinder, which by a suitable way is connected to the support arm. An actuator member can be in association of the pusher, the cutter and the supply means. This actuator governs the proper sequence of complete roll removal, web cutting and core supply. A simple form of the actuator member is a roll contacting bar connected to the outside of a core trough, which is attached to a hollow, cylindrical cutter, both being rotatable around the pusher.

A favourable supply device is possible by providing the supply trough with a releasable locking, for instance, with a pinch grip know per se, by the release of which the core is dropped in the cuneate position between the support drums.

After the cutting, the governing of the web front end can be secured according to the invention with air jets by bending and/or forcing the web against the first support drum during the supply of the new core. A separate retainer member is further applied for the web retaining, for instance, a bar-like retainer or another air nozzle, the air jets of which is directed mainly perpendiculary against the web.

By supporting the cutter and the core supply means to a support arm, the motion path of which is concentric with the first support drum, the construction of the arrangement is easily kept uncomplicated.

It is favourable to attach by attachment material like glue, after the web cutting, the trailing end of the complete roll to the surface of the complete roll and the new leading end of the web to the new roll core. This is possible by arranging attachment material supply means like glue applicators, in the web running direction prior the retainer member, for a supply on a web surface area, which is free from a contact with the first support drum. The function of these supply means should hereby be so arranged, that sized areas are formed at both sides of the generated cutting position located in an unsized area so, that at least one sized area is near the new front portion and at least a corresponding one is in the complete roll near the trailing end portion. Supply means can be applicators located permanently in a row, which is arranged across the web. Attachement stripes can be located at intervals of 150 mm in this transverse direction.

BRIEF DESCRIPTION OF THE DRAWING

The invention is described in the following with reference to the attached drawing, in which.

DESCRIPTION OF A PREFERRED EMBODIMENT

Figure 2:
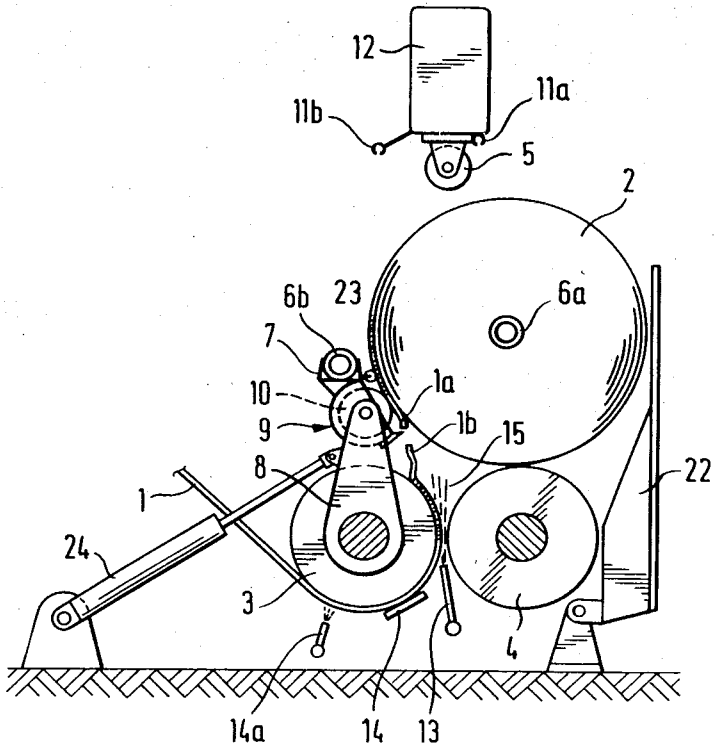
FIGS. 1–4 show process stages of a complete wound paper roll and a new roll core during the core replacement.

Reference numeral 1 in the drawing refers to a paper web and 2 to a complete wound paper roll. The actual winding around a core 6*a* is carried out by means of support drums 3,4 and a rider roll 5 is known per se. For initiating a new winding, the arrangement comprises a new core 6*b* located in a core trough 7. Core trough 7 is provided with a releasable locking means, for instance a pinch grip, by which core 6*b* is locked in trough 7. Core trough 7 is operationally connected to a movable support arm 8, at which is also supported a rotatable cylinder-like pusher roll, tube or drum 10 and a web cutter 9. The motion of support arm 8 is arranged by a known way, for instance, by means of a work cylinder 24. Cutter 9 is a trough-like member, which comprises a lever 23 which in the initial roll transfer stage is arranged to touch roll 2. Cutter 9 partly surrounds pusher 10. Along with the motion of pusher 10, the interaction between lever 23 and roll 2 is further transmitted to the actual cutter blade, for instance by arranging the cutter to rotate relative to pusher 10. This lever 23 governs the proper sequence of pushing roll 2, cutting web 1 and, when no obstructions will hinder a core supply, the supply of new core 6*b*. The embodiment of lever 23 shown in FIGS. 1–4 operates in association with a rotatable cutter cylinder, the two extreme rotation positions are obvious in FIGS. 3, 4. At the opposite side of the complete roll is located a descender 22 for the reception of complete roll 2, when roll 2 is pushed away from drums 3,4. The arrangement comprises pneumatic guide devices like nozzles 11*a* and 11*b* which are connected to a lift device 12 of rider roll 5 and a third pneumatic guide device 13. The latter guide device 13 is operationally connected to a retainer 14 of web 1. Instead of the bar-like retainer 14, one can alternatively apply for the retaining of web 1 an air nozzle 14*a*, the air jet of which is directed mainly perpendicularly against the cut web, and thus, forces the web against first support drum 3. The situation shown in FIG. 1 corresponds to the final phase of a winding carried out around core 6*a*, whereby drums 3 and 4 are stopped. For the cutting of web 1, for pushing away roll 2 which is detached from web 1, and for the supply of new core 6*b* between drums 3,4, support arm 8 along with operative members supported thereat is rotated in the direction of the arrow A. For the disengagement of rider roll 5 from roll 2, lift device 12 is moved in the direction of the arrow B. In order to prevent web 1 during the cutting from being detached from the mantle of drum 3 and, thus, eventually slipping between drums 3,4 under the arrangement, web retainer 14 is brought vertically in contact with web 1 so, that this is firmly against drum 3. This retainment can also be carried out by an air jet of nozzle 14*a*. An air jet arranged from nozzle 13 supports and bends the new front end of web 1, as described later on.

FIG. 2 shows the situation just after the cutting of web 1, whereby pusher 10 has pushed roll 2 away from drum 3. A trailing portion 1*a* of the wound web and a new leading portion 1*b* of web 1 are generated by the cutting of web 1. An air jet 15 is initiated in a position between drums 3 and 4 and roll 2 by pneumatic guide device 13, for instance a nozzle, which is moved between drum 3 and 4. A portion of jet 15 is directed between drums 3 and 4 and roll 2, at the same time bending leading portion 1*b* of the web towards drum 3. The attachment of web trailing end 1*a* to roll 2 can in this embodiment be carried out by an arrangement known per se, for instance by staples or by a sticker tape.

Figure 1:
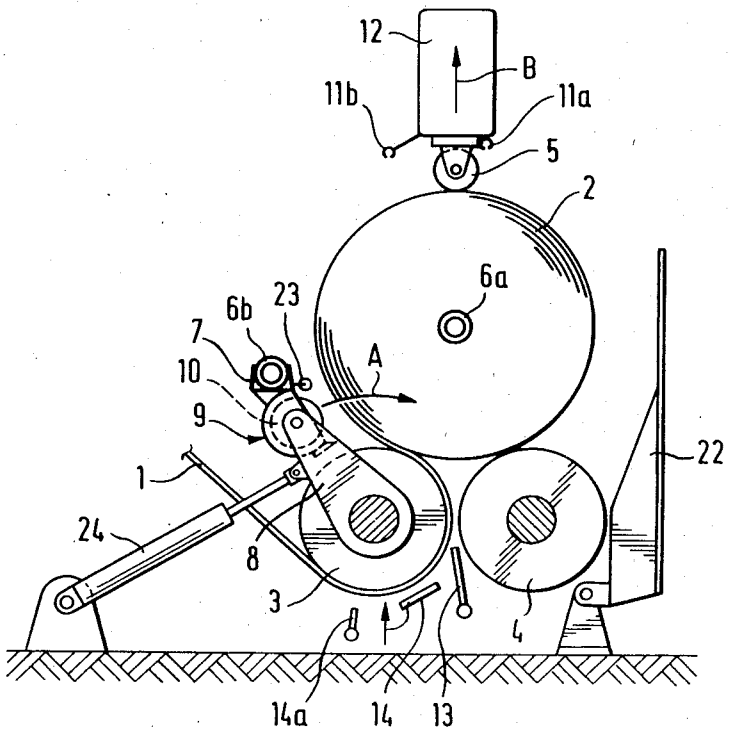
Figure 3:
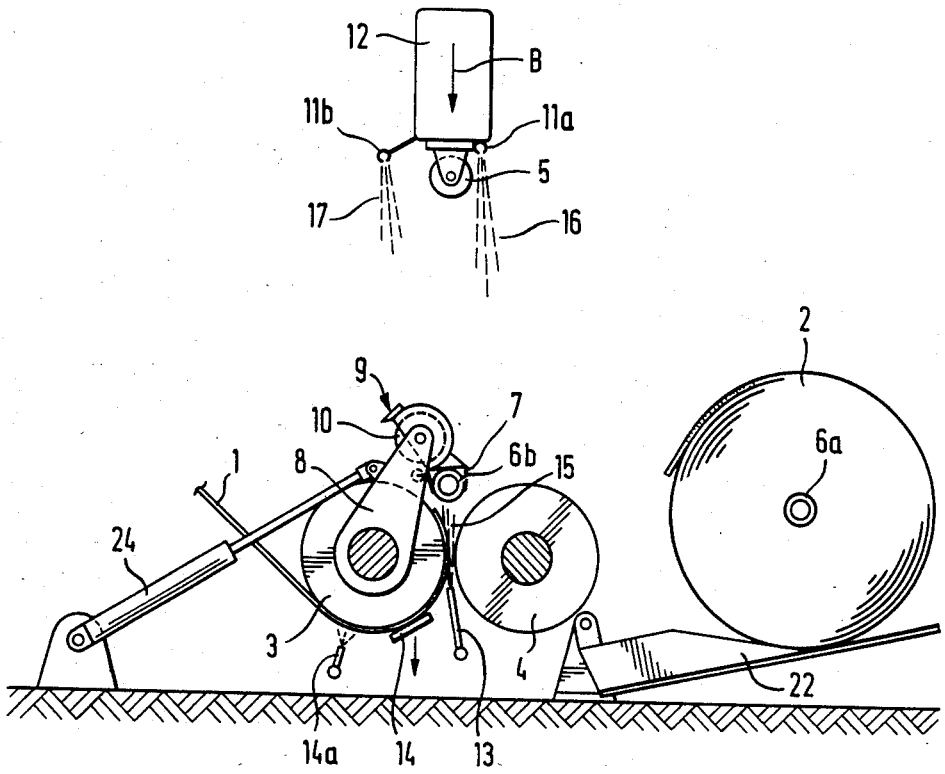

Roll 2 is moved in to descender device 22 in FIG. 3. At the same time, core trough 7 is rotated around pusher 10 so that, after the release of the pinch grip, core 6*b* is freely dropped between drums 3 and 4 to be supported by them. For an effective forcing of leading portion 1*b* of web 1 against drum 3, air jets 15 are produced by guide device 13. Roll pusher 10, web retainer 14 and the function of nozzle 14*a* are returned to one's initial position as shown in FIG. 1. Rider roll 5 is lowered into contact with core 6*b*, after which the winding of web leading portion 1*b* around core 6*b* is initiated. The guiding of web leading end is carried out by rider roll 5, and by jets 16 and 17 of nozzles 11*a* and 11*b* and jets 15 of nozzle 13 so that jets 15 and 17 are activated prior to starting operation of the machine at crawling speed and, after the crawling speed operation is started, jet 16 is also activated. Thereby leading portion 1*b* is easily guided tightly around core 6*b* through the nips in the winding position.

DESCRIPTION OF ANOTHER EMBODIMENT

Figure 4:
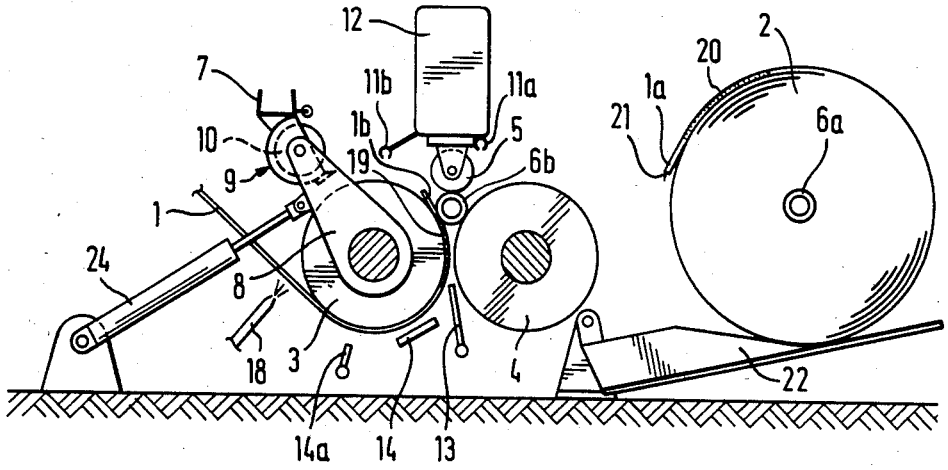

FIG. 4 shows another embodiment for the guiding of leading portion 1*b* of web 1 around new core 6*b*. Reference numeral 18 refers to permanent glue nozzles set in a row. During the crawling stage of drums 3 and 4, glue stripe groups 19 and 20 are sprayed on web 1 before the cutting of this. Stripe groups 19 and 20 are located at different sides of the future cutting position 21 of web 1, so that group 20 forms the attachment of trailing portion 1*a* of complete roll 2 to roll 2 and leading portion 1*b* is attached to new core 6*b* by group 19. A single stripe in group 19 and 20 is directed along web 1, so that neighbouring stripes in the same group are at distance of about 150 mm in the transverse direction of web. In this embodiment of the arrangement a protective device can further be applied, by which one prevents drum 3 being stained by glue. A short unsized portion of the web is located between stripes 19 and 20, so that cutting portion 21 is without cutter blade staining glue.

The invention is not limited to the embodiment shown but several modifications thereof are feasible within the scope of the attached claims. The embodiment according to FIG. 4, for instance, can be provided by a member functionally corresponding air nozzle 11*b* shown in FIG. 3.

We claim:

1. Apparatus for winding a web onto a roll take-up member, comprising first and second support drums defining a web winding position therebetween, means defining a receiving position for a complete roll, said second support drum being between the first support drum and the receiving position, means for transferring the complete roll over the second support drum from the winding position to the receiving position, a web cutter for severing the web when a roll has been completed, and means for supplying a new roll take-up member into the winding position by downwards motion under the influence of gravity, the transfer means, the web cutter and the supply means being mechanically connected together so that when a roll has been completed and the transfer means are actuated, the following operations occur, in the order stated, (a) the transfer means displace the complete roll from the winding position in the direction towards the receiving position, (b) the web cutter severs the web to form new leading and trailing ends of the web, and (c) the supply means supply a new roll take-up member into the winding position, and the apparatus further comprising guide devices and retainer devices for controlling movement of the leading end of the web after severing, said guide devices guiding the new leading end of the web into a position in which it contacts the first support drum, so that when the new roll take-up member is received in the winding position the new leading end of the web is between the new roll take-up member and the first support drum, and said retainer devices being separate from the first drum and generating a force directed against the first drum.

2. Apparatus according to claim 1, further comprising attachment material supply means for applying attachment material to a surface area of the web which does not contact the first drum to attach the new trailing end to the complete roll and the new leading end to the new take-up member.

3. Apparatus according to claim 2, wherein at least one of the retainer devices comprises a retainer member which is arranged to co-operate with the first drum, and the attachment material supply means are located upstream of said retainer member with respect to the running direction of the web for applying attachment material to the web.

4. Apparatus according to claim 2, in which the attachment material supply means are arranged to apply attachment material to the web both upstream and downstream, with respect to the running direction of the web, of the position at which the web cutter severs the web.

5. Apparatus according to claim 2, wherein the attachment material supply means comprise means for applying glue to the web.

6. Apparatus according to claim 5, wherein the attachment material supply means comprise glue supply nozzles.

7. Apparatus according to claim 6, wherein the glue supply nozzles are arranged in a row which extends in the transverse direction of the web, the nozzles being spaced apart in the row by a distance of about 150 mm to form parallel, discrete attachment stripes.

8. Apparatus according to claim 1, comprising a support member to which the transfer means, the web cutter and the supply means are mechanically connected, and a common actuator device connected to drive the support member.

9. Apparatus according to claim 8, wherein the common actuator device comprises a work cylinder.

10. Apparatus according to claim 1, wherein the transfer means comprise a movable support arm, a pusher member carried by the support arm for engaging the complete roll in the winding position, and an actuator device for driving the support arm to move and thereby cause the pusher member to engage the complete roll and push it over the second drum, and wherein the web cutter and the supply means are mechanically connected to the support arm for movement therewith.

11. Apparatus according to claim 10, wherein both the supply means and the web cutter are rotatably supported by the movable support arm and operate upon movement of the support arm by the actuator device, the web cutter comprising a blade and a lever connected to the blade and mounted to pivot about an axis that is spaced from the blade, so that when the actuator device drives the support arm to move and cause the pusher member to engage the complete roll, the lever engages the complete roll and pivots the blade into cutting relationship with the web.

12. Apparatus according to claim 10, wherein at least one of said retainer devices operates without itself contacting the web.

13. Apparatus according to claim 10, wherein the coordinating means coordinate the operation of the transfer means so that, in operation (a), the transfer means displace the complete roll from the winding position to an intermediate position that is between the winding position and the receiving position and, in operation (c), the transfer means displace the complete roll from the intermediate position to the receiving position.

14. Apparatus according to claim 10, wherein the support arm is mounted to pivot about the axis of rotation of the first drum.

15. Apparatus according to claim 14, wherein the web cutter comprises a blade and a lever connected to the blade and mounted to pivot about an axis that is spaced from the blade, so that when the actuator device drives the support arm to pivot and cause the pusher member to engage the complete roll, the lever engages the complete roll and pivots the blade into cutting relationship with the web.

16. Apparatus according to claim 15, wherein the supply means comprise a supply trough for receiving the new take-up member, the supply trough being attached to said lever so that prior to pivoting of the support arm to bring the pusher into engagement with the complete roll the trough is open upwards, and when the support arm is pivoted sufficiently for the pusher member to have transferred the complete roll to the receiving position, the lever pivots further and the trough is inverted over the winding position.

17. Apparatus according to claim 1, wherein the transfer means comprise a pivotable support arm and the web cutter and the supply means are rotatably supported by the support arm.

18. Apparatus according to claim 17, wherein the support arm is mounted to pivot about the axis of rotation of the first drum.

19. Apparatus according to claim 1, wherein at least one of said retainer devices operates without itself contacting the web.

20. Apparatus according to claim 1, wherein the first and second drums are arranged substantially horizontally and the web is fed to the web winding position from a position on the opposite side of the first drum from the second drum and passes under said first drum, and the retainer devices comprise means for holding the web against the first drum after severing.

21. Apparatus according to claim 20, wherein the retainer devices comprise pneumatic jets.

22. Apparatus according to claim 1, wherein the supply means are operative to supply a new take-up member to the winding position by allowing the new take-up member to fall freely under the influence of gravity into the winding position.

23. Apparatus according to claim 1, wherein the transfer means comprises a movable support arm and the web cutter and the supply means are mechanically connected to the support arm for movement therewith.

24. Apparatus according to claim 1, wherein the supply means comprise a supply trough for receiving the new take-up member and having means for releasably holding the new take-up member in the trough.

25. Apparatus according to claim 24, wherein the supply trough is pivotable between a receiving position in which it is open upwards for receiving a new take-up member and a discharge position in which it is open downwards for dropping the new take-up member into the winding position.

26. Apparatus according to claim 1, wherein the supply means are connected to the web cutter.

27. Apparatus according to claim 1, wherein the supply means are operative to supply a new take-up member that is of cylindrical form, and to supply such new take-up member at an arbitrary rotational position about its longitudinal axis by free fall action under the influence of gravity.

28. Apparatus according to claim 1, wherein the guide devices guide the new leading end first to a position between the first drum and the new take-up member, then to a position between the second drum and the new take-up member, and finally to a position in which the leading end becomes trapped between the new take-up member and a portion of the web upstream of the new leading end with respect to the running direction of the web.

29. A method of winding a web onto a succession of roll take-up members, comprising:

(a) positioning a first roll take-up member in a web winding position defined between first and second support drums with the leading end of the web between the first roll take-up member and the first support drum;

(b) rotating the support drums and with them the roll take-up member, so as to wind a length of the web onto the roll take-up member and form a complete roll on the take-up member;

(c) moving the complete roll from the winding position in a direction over the second support drum towards a receiving position, the second support drum being between the winding position and the receiving position;

(d) severing the web and thereby forming new leading and trailing ends of the web;

(e) guiding the new leading end of the web into a position against the first support drum;

(f) completing movement of the complete roll to the receiving position, and delivering a new roll take-up member into the winding position, whereby the new leading end of the web becomes positioned between the new roll take-up member and the first support drum; and (g) repeating step (b), said method also comprising using a common actuator device to bring about movement of the complete roll from the winding position to the receiving position, severing of the web and delivery of the new take-up member into the winding position.

30. A method according to claim 29, wherein step (f) also comprises guiding the new leading end of the web from its position between the new take-up member and the first support drum, around the new take-up member to a position between the second drum and the new take-up member and then farther around the new take-up member to a position in which the new leading end becomes trapped between the new take-up member and a portion of the web upstream of the new leading end with respect to the running direction of the web.

31. A method according to claim 29, further comprising applying attachment material to a surface area of the web which does not contact the first drum to attach the new trailing end of the web to the complete roll and the new leading end to the new take-up member.

32. A method according to claim 31, wherein the attachment material is applied to the web at two positions that are spaced apart along the web, and the web is severed at a position between the two positions at which attachment material is applied to the web.

33. A method according to claim 29, wherein the first and second support drums are arranged substantially horizontally and the method comprises feeding the web to the winding position from a position on the opposite side of the first drum from the second drum and under the first drum, and step (e) also comprises retaining the web against the first drum after severing.

34. A method according to claim 33, comprising blowing pneumatic jets against the web to retain it against the first drum.

35. A method according to claim 29, wherein the new roll take-up member is of cylindrical form, and the step of delivering a new roll take-up member into the winding position is accomplished by allowing the new take-up member to fall freely under the influence of gravity into the winding position at an arbitrary angular position about its longitudinal axis.

36. A method according to claim 35, wherein the new roll take-up member is releasably held in a supply trough, and the new roll take-up member is delivered into the winding position by releasing the new take-up member from the trough.

37. A method according to claim 36, wherein the supply trough is pivotable between a receiving position in which it is open upwards for receiving a new take-up member and a discharge position in which it is open downwards, and the step of delivering a new roll take-up member into the winding position comprises placing the supply trough in its discharge position over the winding position and then releasing the new take-up member from the trough.

38. A method according to claim 29, wherein the common actuator device operates to cause, in sequence, pushing of the complete roll from the winding position towards the receiving position, severing of the web and delivery of the new roll take-up member into the winding position.

39. Apparatus for winding a web onto a roll take-up member, comprising first and second support drums defining a web winding position therebetween, means defining a receiving position for a complete roll, said second support drum being between the first support drum and the receiving position, means for transferring the complete roll over the second support drum from the winding position to the receiving position, a web cutter for severing the web when a roll has been completed, means for supplying a new roll take-up member into the winding position by downwards motion under the influence of gravity, a common actuator device connected to drive the transfer means, the web cutter and the supply means, and means for coordinating the operation of the transfer means, the web cutter and the supply means so that when a roll has been completed and the actuator device is operated, the following operations occur, in the order stated, (a) the transfer means displace the complete roll from the winding position in the direction towards the receiving position, (b) the web cutter severs the web to form new leading and trailing ends of the web, and (c) the supply means supply a new roll take-up member into the winding position.

40. Apparatus for winding a web onto a roll take-up member, comprising first and second support drums defining a web winding position therebetween, means defining a receiving position for a complete roll, said second support drum being between the first support drum and the receiving position, means for transferring the complete roll over the second support drum from the winding position to the receiving position, a web cutter for severing the web when a roll has been completed, and means for supplying a new roll take-up member into the winding position by downwards motion under the influence of gravity, the transfer means comprising a movable support arm, a pusher member carried by the support arm for engaging the complete roll in the winding position, and an actuator device for driving the support arm to move and thereby cause the pusher member to engage the complete roll and push it over the second drum, and the web cutter being rotatably supported by the movable support arm and comprising a blade and a lever connected to the blade and mounted to pivot about an axis that is spaced from the blade, so that when the actuator device drives the support arm to move and cause the pusher member to engage the complete roll, the lever engages the complete roll and pivots the blade into cutting relationship with the web, the supply means also being rotatably supported by the movable support arm so that upon movement of the support arm by the actuator device the following operations occur, in the order stated, (a) the transfer means displace the complete roll from the winding position in the direction towards the receiving position, (b) the web cutter severs the web to form new leading and trailing ends of the web, and (c) the supply means supply a new roll take-up member into the winding position.

* * * * *